United States Patent [19]

Hsu

[11] Patent Number: 4,996,784

[45] Date of Patent: Mar. 5, 1991

[54] INTEGRAL PICTURE FRAME WITH QUICK CHANGEABLE FLEXIBLE DECORATION PART

[76] Inventor: Mary Hsu, 4 Fl., No. 2, Lane 71, An Ho Rd., Taipei, Taiwan

[21] Appl. No.: 464,033

[22] Filed: Jan. 12, 1990

[51] Int. Cl.[5] ..... G47F 1/12

[52] U.S. Cl. ..... 40/152; 40/154; 40/156

[58] Field of Search ..... 40/154, 152, 156

[56] References Cited

U.S. PATENT DOCUMENTS 4,922,638 5/1990 Litvak et al. ..... 40/152

FOREIGN PATENT DOCUMENTS 2214805 9/1989 United Kingdom ..... 40/152

2220138 1/1990 United Kingdom ..... 40/156

*Primary Examiner*—James R. Brittain

*Assistant Examiner*—Cassandra Hope

*Attorney, Agent, or Firm*—Staas & Halsey

[57] ABSTRACT

An integral picture frame with quick changeable flexible decoration part including an annular inner border portion with a inner convex surface, an annular intermediary protrusion portion and an annular outer border portion with an outer convex portion. A number of spaced first ribs formed on an outer surface of the annular inner border portion are attached to a first edge of a first annular flat seat at a lower part of each first rib and thereby defining a first compartment among each two first ribs and the first flat seat. A number of spaced second ribs formed on an inner surface of the annular outer border portion are attached to a first edge of a second annular flat seat at a lower part of each second rib and thereby defining a second compartment among each two second ribs and the second flat seat. Both edges of the annular intermediary protrusion portion respectively protrude upwardly from a second edge of the first annular flat seat and a second edge of the second annular seat and then centrally curved forming a convex surface. A flexible decoration part is changeably engaged onto a front side of the picture frame by means of deformation of two edges of the decoration part such that the deformation parts of two edges of the decoration part are respectively fitted into the first compartments and the second compartments.

1 Claim, 4 Drawing Sheets

INTEGRAL PICTURE FRAME WITH QUICK CHANGEABLE FLEXIBLE DECORATION PART

BACKGROUND OF THE INVENTION

The present invention relates to an integral picture frame with a quick changeable flexible decoration part, and in particular, to an integral picture frame comprising a plurality of ribs and thereby defining a plurality of compartments for facilitating the engagement of the flexible decoration part onto the front surface of the picture frame by simple deformation of the peripheral edges of the flexible decoration part.

SUMMARY OF THE INVENTION

According to one aspect of the present invention, the picture frame is substantially an integral picture frame with a quick changeable flexible decoration part mounted thereon by means of deformation. The present integral picture frame comprises an annular inner border portion, an annular intermediary protrusion portion and an annular outer border portion.

A plurality of spaced first ribs formed on an outer surface of the annular inner border portion are attached to a first edge of a first annular flat seat at a lower part of each first rib and thereby defining a first compartment among each two first ribs and the first annular flat seat. A plurality of spaced second ribs formed on an inner surface of the annular outer border portion are attached to a first edge of a second annular flat seat at a lower part of each second rib and thereby defining a second compartment among each two second ribs and the second flat seat.

Both edges of the annular intermediary protrusion portion respectively protrude upwardly from a second edge of the first annular flat seat and a second edge of the second annular seat and then centrally curved forming a convex surface.

The flexible decoration part is changeably engaged onto a front side of the picture frame by means of deformation of two edges of the flexible decoration part such that the deformation parts of the two edges of the flexible decoration part are respectively fitted into the first compartments and the second compartments.

On a rear side of the picture frame, a first flat rear surface of the annular intermediary protrusion portion has a level higher than a second flat rear surface of the inner border portion and thereby defining a first recess for receiving a glass plate, a picture or the like. Furthermore, an annular plate of paper or the like having a plurality of holes is adhered onto the first flat rear surface. A corresponding number of recesses are formed on the first flat surface related to the position of the holes. Retaining buttons having an eccentric protrusion thereon are provided for retaining the picture and the glass plate within the recess on the rear side of the picture frame as on conventional picture frames.

It is therefore a primary object of the present invention to provide an integral picture frame with a quick changeable flexible decoration part.

It is another object of the present invention to provide a picture frame having a plurality of spaced ribs that define a plurality of compartments for receiving the deformation portions of the flexible decoration part.

It is still another object of the present invention to provide an integral picture frame for facilitating the engagement and changing of the flexible decoration part.

Other objects and advantages of this invention will be apparent to those having ordinary skill in the art when the following detailed description has been read in conjunction with the accompanying drawings.

DETAILED DESCRIPTION OF THE PREFERRED EMBODIMENT

Figure 1:
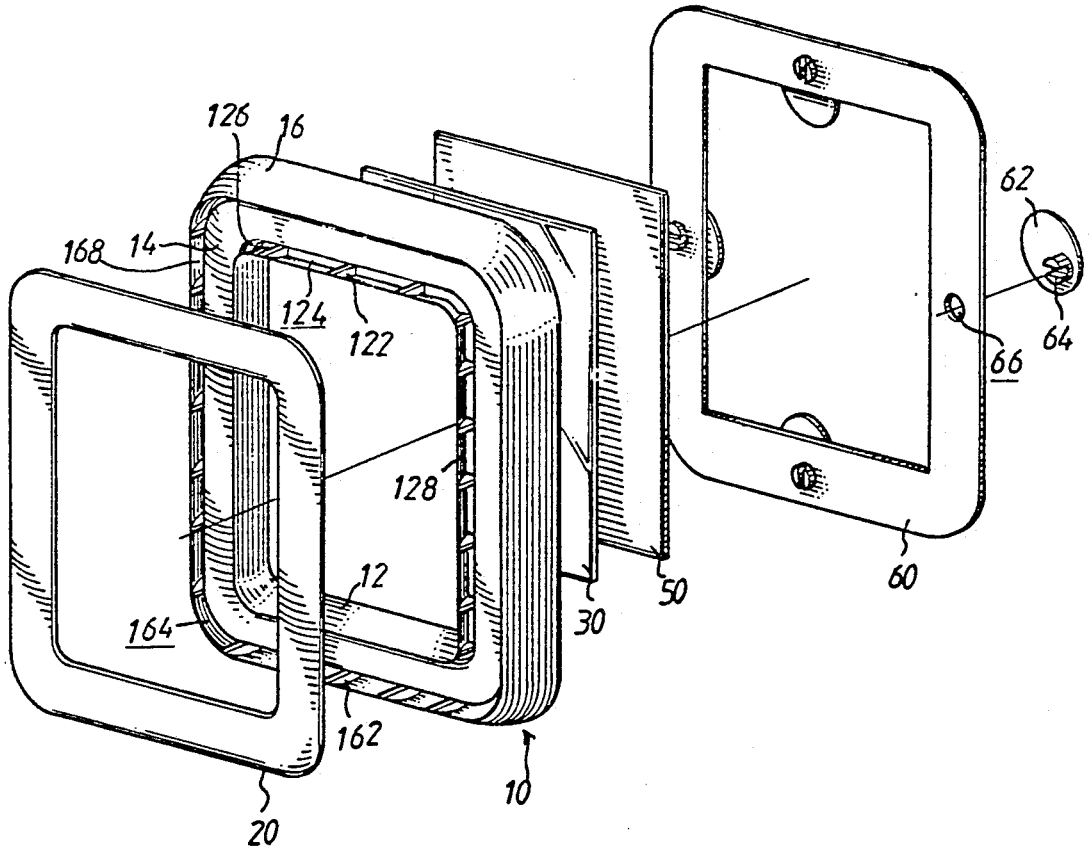
FIG. 1 is an exploded view of an embodiment of an integral picture frame with a quick changeable flexible decoration plate in accordance with the present invention.
Figure 2:
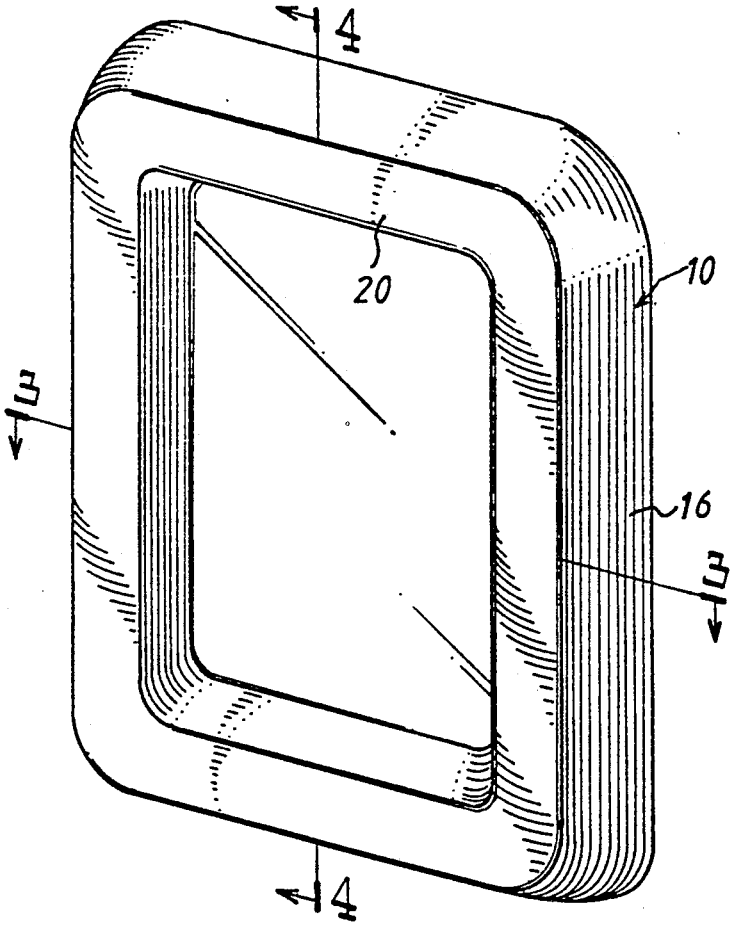
FIG. 2 is a perspective view of the embodiment of an assembled picture frame in accordance with the present invention.

Referring to FIGS. 1 to 4, the picture frame according to the present invention is substantially an integral picture frame 10 with a quick changeable flexible decoration part 20 mounted thereon by means of deformation which will be discussed in more detail hereinafter. The present integral picture frame 10 comprises an annular inner border portion 12 with an inner convex surface, an annular intermediary protrusion portion 14 and an annular outer border portion 16 with an outer convex portion.

A plurality of spaced first ribs 122 formed on an outer surface 128 of the annular inner border portion 12 are attached to a first edge of a first annular flat seat 126 at a lower part of each first rib 122, thereby defining a first compartment 124 among each two first ribs 122 and the first annular flat seat 126. A plurality of spaced second ribs 162 formed on an inner surface 168 of the annular outer border portion 16 are attached to a first edge of a second annular flat seat 166 at a lower part of each second rib 162, thereby defining a second compartment 164 among each two second ribs 162 and the second flat seat 166.

Both edges of the annular intermediary protrusion portion 14 respectively protrude upwardly from a second edge of the first annular flat seat 126 and a second edge of the second annular seat 166 and then centrally curved forming a convex surface.

Figure 4:
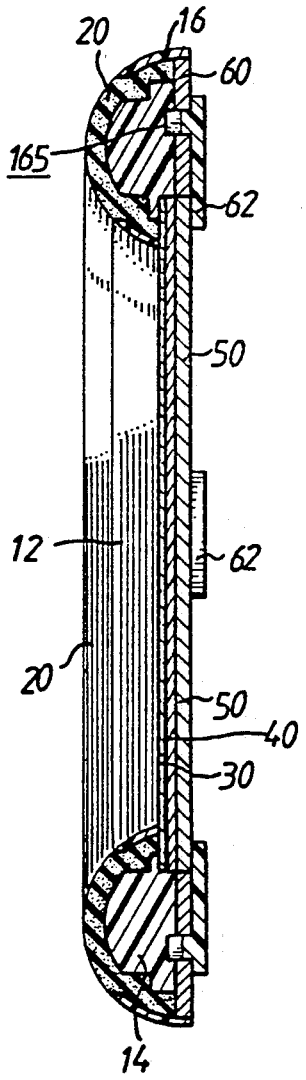
FIG. 4 is a cross-sectional view taken along line 4—4 of FIG. 3.

As shown in FIG. 4, a flexible decoration part 20 is changeably engaged onto a front side of the picture frame 10 by means of deformation of two edges of the flexible decoration part 20 such that the deformation portions of two edges of the flexible decoration part 20 are respectively fitted into the first compartments 124 and the second compartments 164.

Figure 3:
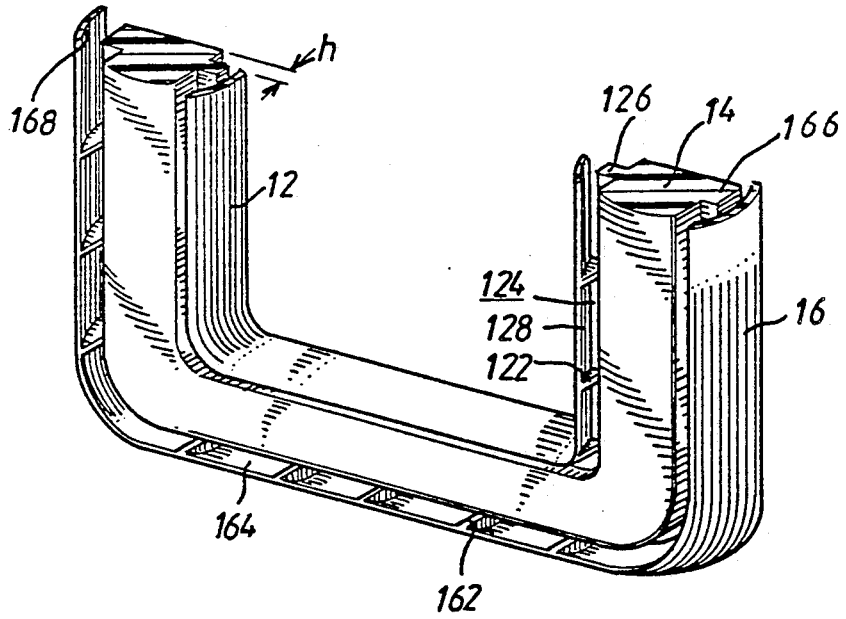
FIG. 3 is a perspective view cut along line 3—3 of FIG. 2.

On a rear side of the picture frame 10, a first flat rear surface of the annular intermediary protrusion portion 14 has a level higher than a second flat rear surface of the inner border portion 12 and thereby defining a first recess for receiving a glass plate 30, a picture 40 or the like, as shown in FIG. 3 and indicated by h. Furthermore, an annular plate 60 of paper or the like having a plurality of holes 66 is adhered onto the first flat rear surface. A corresponding number of recesses 165 are formed on the first flat surface related to the position of the holes 66. Retaining buttons 62 having an eccentric protrusion 64 thereon are provided within the holes 66 and the recesses 165 for retaining the picture 40 and the glass plate 30 within the recess (the h portion) on the rear side of the picture frame 10 which is conventional, with no explanation needed. Also, a back plate 50 may be provided behind the picture 40 as on conventional picture frames.

Although this invention has been described with a certain degree of particularity, it will be understood that the present invention disclosure is made by way of example only and that numerous changes in the detail of construction and the combination and arrangement of parts may be resorted to without departing from the spirit and the scope of the invention as hereinafter claimed.

I claim:

1. An integral picture frame with a quick changeable flexible decoration part comprising: an annular inner border portion with an inner convex surface, an annular intermediary protrusion portion and an annular outer border portion with an outer convex portion, a plurality of spaced first ribs formed on an outer surface of said annular inner border portion being attached to a first edge of a first annular flat seat at a lower part of each first rib and thereby defining a first compartment among each two first ribs and said first flat seat, said first flat seat having a second edge opposite to said first edge of said first flat seat, a plurality of spaced second ribs formed on an inner surface of said annular outer border portion being attached to a first edge of a second annular flat seat at a lower part of each second rib and thereby defining a second compartment among each two second ribs and said second flat seat, said second flat seat having a second edge opposite to said first edge of said second flat seat, said annular intermediary protrusion portion having two opposite edge walls respectively protruding upwardly from said second edge of said first annular flat seat and said second edge of said second annular seat and then centrally curved to form a convex surface, a flexible decoration part being changeably engaged onto a front side of said picture frame by means of deformation of two edges of said decoration part such that the deformation portions of said two edges of said decoration part are respectively fitted into said first compartments and said second compartments; on a rear side of said picture frame, a first flat rear surface of said annular intermediary protrusion portion having a level higher than a second flat rear surface of said annular inner border portion and thereby defining a recess for receiving a glass plate and a picture.

* * * * *